US012116883B2

(12) United States Patent
Mugharbil et al.

(10) Patent No.: US 12,116,883 B2
(45) Date of Patent: Oct. 15, 2024

(54) ANNULUS PRESSURE MONITORING, REPORTING, AND CONTROL SYSTEM FOR HYDROCARBON WELLS

(71) Applicant: Saudi Arabian Oil Company, Dhahran (SA)

(72) Inventors: Mohammed K. Mugharbil, Al Khobar (SA); Ahmad Muhammad, Abqaiq (SA); Mohammed H. Malki, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/095,766

(22) Filed: Jan. 11, 2023

(65) Prior Publication Data

US 2024/0229640 A1 Jul. 11, 2024

(51) Int. Cl.
*E21B 47/06* (2012.01)
*E21B 47/117* (2012.01)

(52) U.S. Cl.
CPC ..... *E21B 47/06* (2013.01); *E21B 47/117* (2020.05); *E21B 2200/20* (2020.05); *E21B 2200/22* (2020.05)

(58) Field of Classification Search
CPC ..... E21B 47/06; E21B 47/10; E21B 47/117
See application file for complete search history.

(56) References Cited

U.S. PATENT DOCUMENTS

| | | | | |
|---|---|---|---|---|
| 6,513,596 | B2 * | 2/2003 | Wester | E21B 47/001 166/336 |
| 10,113,410 | B2 * | 10/2018 | Stephens | E21B 47/001 |
| 10,519,761 | B2 * | 12/2019 | Patel | E21B 33/13 |
| 10,844,693 | B2 * | 11/2020 | Douglas | E21B 43/12 |
| 11,781,418 | B2 * | 10/2023 | Hoeie | E21B 47/007 73/40 |
| 2009/0071657 | A1 | 3/2009 | Johnson | |
| 2009/0133878 | A1 | 5/2009 | Hermes et al. | |

(Continued)

FOREIGN PATENT DOCUMENTS

| | | |
|---|---|---|
| WO | WO 2001057360 | 8/2001 |
| WO | WO 2015065453 | 5/2015 |
| WO | WO 2015147806 | 10/2015 |

OTHER PUBLICATIONS

Omosebi, et al., "Annular Pressure Prediction During Well Control," presented at the Nigeria Annual International Conference and Exhibition, Lagos, Nigeria, Aug. 6-8, 2012, 9 pages.

*Primary Examiner* — Kenneth L Thompson
(74) *Attorney, Agent, or Firm* — Fish & Richardson P.C.

(57) ABSTRACT

Systems and methods for monitoring pressure in hydrocarbon wells for controlling operation of the hydrocarbon well are configured for operations comprising receiving pressure data for a well, the pressure data comprising values of a pressure in a well annulus over a period of time for a set of wells; identifying one or more anomalies in the pressure data by comparing the values of the pressure to threshold values, the anomalies in the pressure data representing an anomalous pressure condition for a well; determining, based on the one or more anomalies, a failure factor for one or more wells associated with the anomalies; and predicting, based on the failure factor, a cycle time of anomalies in the pressure conditions for the one or more wells.

18 Claims, 5 Drawing Sheets

(56) References Cited

U.S. PATENT DOCUMENTS

| | | | | |
|---|---|---|---|---|
| 2016/0222741 | A1 | 8/2016 | Lovorn et al. | |
| 2021/0156244 | A1 | 5/2021 | Hoeie et al. | |
| 2023/0080453 | A1* | 3/2023 | Idris | E21B 47/06 166/250.01 |

* cited by examiner

ANNULUS PRESSURE MONITORING, REPORTING, AND CONTROL SYSTEM FOR HYDROCARBON WELLS

TECHNICAL FIELD

The present disclosure generally relates to systems for hydrocarbon extraction. More specifically, this specification describes systems that automatically monitor hydrocarbon wells for faults during well drilling and extraction of hydrocarbons.

BACKGROUND

Thermal expansion is a common natural phenomenon. It occurs when an object expands and becomes larger due to a change in the object's temperature as a result of the heat generated by the temperature. Temperature or thermal energy is the average kinetic energy of the atoms or molecules in a substance. When heat is applied to an object, the molecules become energized and move faster. They collide with other molecules and take up more space thereby increasing the pressure of the system.

In hydrocarbon production, a wellbore is drilled into a hydrocarbon-rich geological formation. After the wellbore is partially or completely drilled, a completion system is installed to secure the wellbore in preparation for production or injection. The completion system can include a series of casings or liners cemented in the wellbore to help control the well and maintain well integrity.

Thermal expansion of TCA (tubing casing annulus) fluids caused by the radial heat transfer from the upward flow of wellbore fluids to the TCA can result in excessive TCA pressure which is a key well integrity consideration during the initial start-up of a newly drilled or worked-over well. This resultant build-up of TCA pressure is a function of the change in temperature of the annular fluid and the volumetric change in the sealed annulus.

SUMMARY

The data processing system described in this specification is configured to process well data representing an established anomalous trend of annuli survey data of a well. The data processing system empirically establishes a baseline failure model. The data processing system is configured to predict annuli pressure decline or build rate for the well based on data analytics (such as machine learning models).

The data processing system receives annuli survey data sets (historical data sets), which include date, time, pressures, and volumes data, for wells. The wells have anomalous TCA and/or CCA conditions that have been identified. The data processing system analyses a set of surveys. The data processing system determines a pressure decline rate or a pressure build-up rate, representing a failure factor. The data processing system calculates the failure factor and determines an average pressure drop or build-up per day between survey intervals. The data processing system, based on the determined failure factor, predicts the cycle times of anomalies in annuli pressure conditions.

The data processing system described in this specification is configured to quantify a transient build-up of annular pressure. The data processing system is configured to combine effects of thermal and volumetric changes of the annular fluid and casing for making this quantification. The data processing system assumes a linear fluid heat-up behavior and elastic plasticity of the tubing without thermal transfer to the adjacent annulus.

The data processing system thus uses a mathematical model to quantify the transient build-up of annular pressure by combining the effects of thermal and volumetric changes of the annular fluid and casing. The data processing system generally uses a model that includes a linear fluid heat-up behavior and elastic plasticity of the tubing without thermal transfer to the adjacent annulus (e.g., a single pipe and single-phase fluid).

The described implementations can provide various advantages or benefits. The data processing system can predict a cycle of anomalies in annuli pressures (TCA/CCA) using a well's annuli survey history. This enhances quick remedial action for wells with predicted annuli integrity issues. In some implementations, this process enables preventative remedial measures to be performed, reducing cost of well maintenance. The data processing system is configured to calculate annuli failure factors (such as pressure decline or build-up rates) and use data analytics to predict the next expected remedial action (e.g. TCA refill or pressure bleed-down).

The processes can enable predictions of well pressures at different points in time using simple input values that are widely available for tens or hundreds of wells in the field. This enables improved control and maintenance of wells in the field.

The systems and devices can include one or more of the following embodiments.

In a general aspect, a process for monitoring pressure in hydrocarbon wells for controlling operation of the hydrocarbon well includes receiving pressure data for a well, the pressure data comprising values of a pressure in a well annulus over a period of time for a set of wells. The process includes identifying one or more anomalies in the pressure data by comparing the values of the pressure to threshold values, the anomalies in the pressure data representing an anomalous pressure condition for a well. The process includes determining, based on the one or more anomalies, a failure factor for one or more wells associated with the anomalies. The process includes predicting, based on the failure factor, a cycle time of anomalies in the pressure conditions for the one or more wells.

In some implementations, the failure factor comprises a pressure build up rate or a pressure decline rate for each well of the one or more wells.

In some implementations, the process includes receiving labeled data representing pressure build up rates and pressure decline rates for one or more wells of the set of wells, wherein the labeled data are labeled with known anomalies that are included in the labeled data for the one or more wells of the set of wells. The process can include training a machine learning model using the labeled data, the machine learning model being trained to predict the cycle time of anomalies in the pressure conditions for the one or more wells.

In some implementations, the one or more anomalies comprise at least one of a zero pressure in a tubing casing annulus (TCA) of a well under a flowing condition, a pressure over a maximum threshold pressure in the TCA, a casing-casing annulus (CCA) pressure that exceeds a threshold, and an equal tubing and TCA pressure under an SI condition.

In some implementations, the process includes, based on the prediction of the cycle time of the anomalies, causing one or more remedial actions for a well of the set of wells. In some implementations, the remedial action comprises at least one of a as TCA refill, a TCA lubrication, and a pressure bleed-off for the well of the set of wells.

In some implementations, the process includes controlling a pressure in the well, based on the predicting, wherein controlling comprises causing one or more of a pressure bleed off event and generation of a notification instructing an operator to inspect the well for leakage or blockage, the notification being transmitted to the operator.

In an aspect, a system is configured for monitoring pressure in hydrocarbon wells for controlling operation of the hydrocarbon well. The system includes at least one processor; and a memory storing instructions that, when executed by the at least one processor, cause the at least one processor to perform operations. The operations include receiving pressure data for a well, the pressure data comprising values of a pressure in a well annulus over a period of time for a set of wells. The operations include identifying one or more anomalies in the pressure data by comparing the values of the pressure to threshold values, the anomalies in the pressure data representing an anomalous pressure condition for a well. The operations include determining, based on the one or more anomalies, a failure factor for one or more wells associated with the anomalies. The operations include predicting, based on the failure factor, a cycle time of anomalies in the pressure conditions for the one or more wells.

In some implementations, the failure factor comprises a pressure build up rate or a pressure decline rate for each well of the one or more wells.

In some implementations, the operations include receiving labeled data representing pressure build up rates and pressure decline rates for one or more wells of the set of wells, wherein the labeled data are labeled with known anomalies that are included in the labeled data for the one or more wells of the set of wells. The operations can include training a machine learning model using the labeled data, the machine learning model being trained to predict the cycle time of anomalies in the pressure conditions for the one or more wells.

In some implementations, the one or more anomalies comprise at least one of a zero pressure in a tubing casing annulus (TCA) of a well under a flowing condition, a pressure over a maximum threshold pressure in the TCA, a casing-casing annulus (CCA) pressure that exceeds a threshold, and an equal tubing and TCA pressure under an SI condition.

In some implementations, the operations include, based on the prediction of the cycle time of the anomalies, causing one or more remedial actions for a well of the set of wells. In some implementations, the remedial action comprises at least one of a as TCA refill, a TCA lubrication, and a pressure bleed-off for the well of the set of wells.

In some implementations, the operations include controlling a pressure in the well, based on the predicting, wherein controlling comprises causing one or more of a pressure bleed off event and generation of a notification instructing an operator to inspect the well for leakage or blockage, the notification being transmitted to the operator.

In an aspect, one or more non-transitory computer readable media storing instructions for monitoring pressure in hydrocarbon wells for controlling operation of the hydrocarbon well, the instructions when executed by at least one processor, configured to cause the at least one processor to perform operations. The operations include receiving pressure data for a well, the pressure data comprising values of a pressure in a well annulus over a period of time for a set of wells. The operations include identifying one or more anomalies in the pressure data by comparing the values of the pressure to threshold values, the anomalies in the pressure data representing an anomalous pressure condition for a well. The operations include determining, based on the one or more anomalies, a failure factor for one or more wells associated with the anomalies. The operations include predicting, based on the failure factor, a cycle time of anomalies in the pressure conditions for the one or more wells.

In some implementations, the failure factor comprises a pressure build up rate or a pressure decline rate for each well of the one or more wells.

In some implementations, the operations include receiving labeled data representing pressure build up rates and pressure decline rates for one or more wells of the set of wells, wherein the labeled data are labeled with known anomalies that are included in the labeled data for the one or more wells of the set of wells. The operations can include training a machine learning model using the labeled data, the machine learning model being trained to predict the cycle time of anomalies in the pressure conditions for the one or more wells.

In some implementations, the one or more anomalies comprise at least one of a zero pressure in a tubing casing annulus (TCA) of a well under a flowing condition, a pressure over a maximum threshold pressure in the TCA, a casing-casing annulus (CCA) pressure that exceeds a threshold, and an equal tubing and TCA pressure under an SI condition.

In some implementations, the operations include, based on the prediction of the cycle time of the anomalies, causing one or more remedial actions for a well of the set of wells. In some implementations, the remedial action comprises at least one of a as TCA refill, a TCA lubrication, and a pressure bleed-off for the well of the set of wells.

In some implementations, the operations include controlling a pressure in the well, based on the predicting, wherein controlling comprises causing one or more of a pressure bleed off event and generation of a notification instructing an operator to inspect the well for leakage or blockage, the notification being transmitted to the operator.

The details of one or more embodiments are set forth in the accompanying drawings and the description below. Other features and advantages will be apparent from the description and drawings, and from the claims.

DETAILED DESCRIPTION

Figure 1:
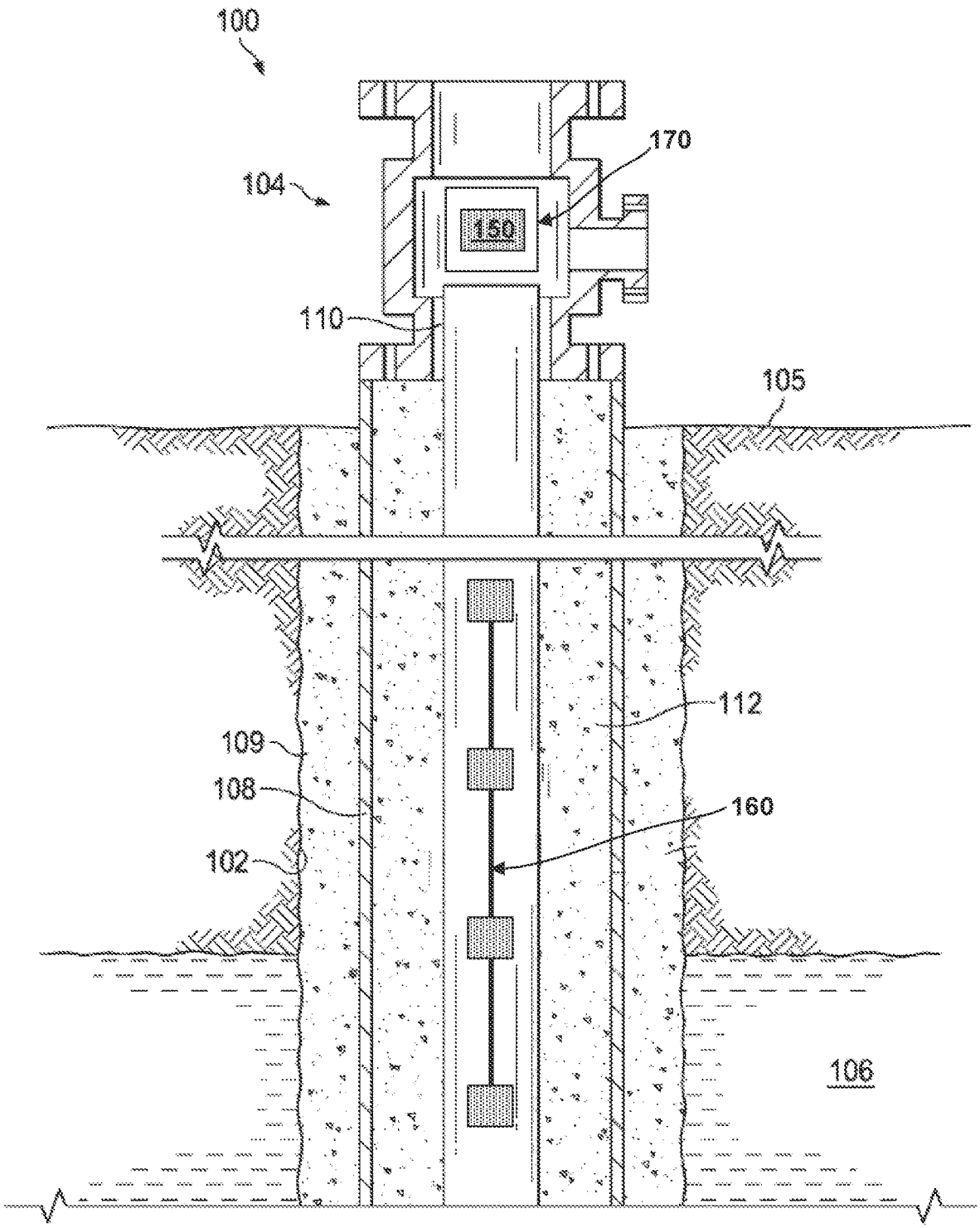
FIG. 1 is a drawing of an exemplary well system in accordance with an embodiment of the present disclosure.

Routine monitoring of annuli pressures, including tubing-casing annulus (TCA) and casing-casing annulus (CCA) pressures is a diagnostic evaluation for well integrity for oil, gas & water wells. For a region or set of wells, a system performs periodic annuli surveys for shut-in and flowing well conditions. The system processes annuli pressure survey data that is reported by the wells of the system. The pressure data, which can be included in log data, are analyzed. The system determines whether one or more anomalies are occurring for a given well. The anomalies can include a static wellhead, dynamic downhole leaks, or any other well integrity anomalies. An anomaly can be identified as when data from the log of one or more well violates guidelines, thresholds, or other acceptance criteria that are established as representing the boundaries for nominal well behavior. These thresholds or boundaries can be set based on historical data associated with the given well or with a set of wells that are associated with the given well or otherwise are representative of the given well.

The system (such as a data processing system) process the well log data and determines whether pressure values of these data indicate an anomalous operational condition for a well. For example, the anomalous operational condition can include a pressure condition that violates a threshold value, such as a high TCA/CCA value, a zero TCA value, and so forth. These values may indicate blockage, leaks, or another faults for the well. Once an anomalous annuli pressure condition is identified, the data processing system generates data to cause a remedial action, such as a TCA refill, a TCA lubrication, and/or a pressure bleed-off for the well. The remedial action(s) can be performed to diagnose and confirm a suspected leak for the well. The remedial action can be performed periodically due to thermal expansion or degradation of TCA fluid within the well.

The data processing system described in this specification is configured to process well data representing an established anomalous trend of annuli survey data of a well. The data processing system empirically establishes a baseline failure model. The data processing system is configured to predict annuli pressure decline or build rate for the well based on data analytics (such as machine learning models).

The data processing system receives annuli survey data sets (historical data sets), which include date, time, pressures, and volumes data, for wells. The wells have anomalous TCA and/or CCA conditions that have been identified. The data processing system analyses a set of surveys. The data processing system determines a pressure decline rate or a pressure build-up rate, representing a failure factor. The data processing system calculates the failure factor and determines an average pressure drop or build-up per day between survey intervals. The data processing system, based on the determined failure factor, predicts the cycle times of anomalies in annuli pressure conditions.

The data processing system obtains a profile of what the pressure build-up or drop of cycle for one or more wells, responsive to remedial actions. In some implementations, the measured result is set as the baseline. For example, the data processing system compares the new data to the baseline data and determines if a data profile does not match within acceptable tolerance. For example, the data processing system determines that a drop rate or build-up rate is different than expected. If values deviate too much, the data processing system generates an alert or an anomaly report. The data processing system can control the well to cause a remedial action, such as a bleed off, or notify an operator to inspect the well for leakage or blockage. For example, the data processing system can control a pressure in the well. The data processing system can cause a pressure bleed off event. In some implementations, the data processing system generates a notification instructing an operator to inspect the well for leakage or blockage. The data processing system causes the notification to be transmitted to the operator.

The data processing system uses the build-up/drop-off factor (rate) to predict the next anomaly cycle. For example, if the decline rate is 5 pounds per square inch (PSI) per day, and current TCA pressure is 500 psi, the data processing system expects that it will take 100 days (500 psi/5 (psi/day)) to reach a zero TCA pressure. The new actual field data will be used to update the model in order recalculate the average decline rate.

The data processing system described in this specification is configured to quantify a transient build-up of annular pressure. The data processing system is configured to combine effects of thermal and volumetric changes of the annular fluid and casing for making this quantification. The data processing system assumes a linear fluid heat-up behavior and elastic plasticity of the tubing without thermal transfer to the adjacent annulus.

The data processing system automatically generates several equations based on the input parameters including thermal and volumetric changes of the annular fluid. The data processing system provides a pressure-increase prediction for the tubing casing annulus for different wells. The different wells can have different configurations (geometries) and TCA fluid types. The data processing system calculates pressure increases due to thermal expansion of a liquid fully filling (without any gas bubbles or pockets) a metallic enclosure of the well annulus. The data processing system determines the expected pressure based on a thermal expansion of liquid due to the change of the liquid's bulk temperature, thermal expansion of the vessel or pipe, (generally having the same or similar temperature as the fluid), a compressibility of liquid under the increase in pressure due to the constrained volume, and an increase in volume of the vessel under the increased pressure of the fluid.

FIG. 1 is a schematic partial cross-sectional side view of an example well system 100. The well system 100 can be monitored for pressure build-up and drop-off, as subsequently described. The well system 100 includes a substantially cylindrical wellbore 102 extending from a wellhead 104 at a surface 105 downward into the Earth into one or more subterranean zones of interest. The example well system 100 shows one subterranean zone 106; however, the example well system 100 can include more than one zone. The well system 100 includes a vertical well, with the wellbore 102 extending substantially vertically from the surface 105 to the subterranean zone 106. The concepts described here, however, are applicable to many different configurations of wells, including vertical, horizontal, slanted, or otherwise deviated wells.

The wellhead 104 defines an attachment point for other equipment of the well system 100 to attach to the well 102. For example, the wellhead 104 can include a Christmas tree structure including valves used to regulate flow into or out of the wellbore 102, or other structures incorporated in the wellhead 104. For example, the wellhead can include one or more sensors in a sensor package 150, shown as coupled to the wellhead 104. The one or more sensors of the sensor package are configured to measure well annulus pressure. In some implementations, pressure sensors 160 can be placed in other locations in the well system 100, such as inside the casing 104 annulus. The sensors 150, 160 of the well system 100 are configured to measure operational values associated with the well system, including a pressure in the annulus of the well. The pressure in the annulus is measured to determine whether any leaks have occurred, among other possible operational issues. The well pressure can be measured continuously or at intervals, and these data can be included in a well log.

Figure 5:
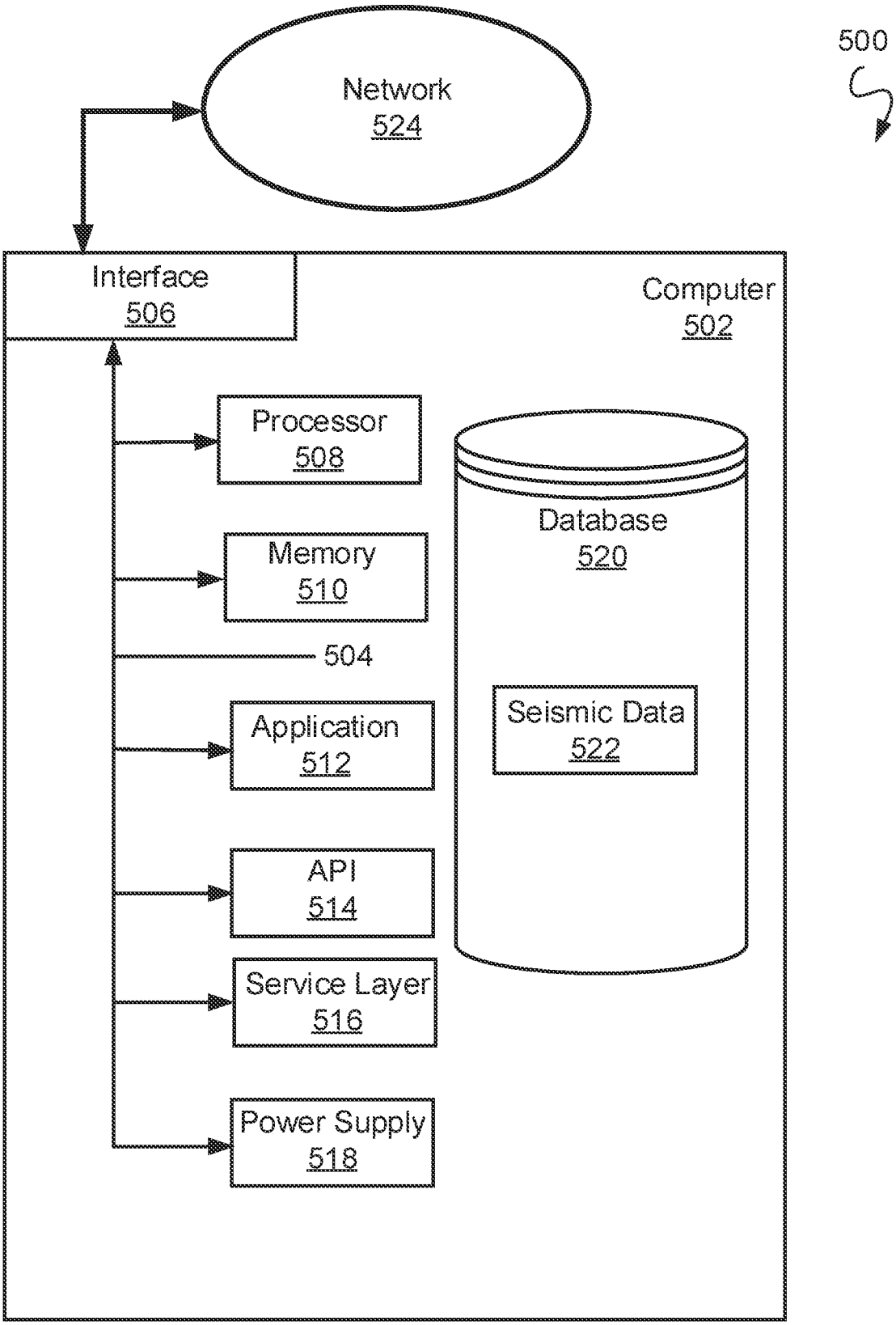
FIG. 5 is a diagram of an example computing system.

A logging system 170 of the well system 100 includes computing devices (such as described in relation to FIG. 5). The logging system 170 gathers data, including data from sensors 150, 160. The logging system 170 generates well log data representing the operational status of the well system 100. The well logging system 170 is configured to transmit or otherwise send the log data to a control center or other remote computing device (not shown). The control center can receive log data from a plurality of well systems similar to well system 100. These data can represent operation of the wells of a region, such as a reservoir including tens or hundreds of wells.

After some or all of the wellbore 102 is drilled, a portion of the wellbore 102 extending from the wellhead 104 to the subterranean zone 106 can be lined with lengths of tubing, called casing or liner. The wellbore 102 can be drilled in stages, the casing can be installed between stages, and cementing operations can be performed to inject cement in stages between the casing and a cylindrical wall positioned radially outward from the casing. The cylindrical wall can be an inner wall of the wellbore 102 such that the cement is disposed between the casing and the wellbore wall, the cylindrical wall can be a second casing such that the cement is disposed between the two tubular casings, or the cylindrical wall can be a different substantially tubular or cylindrical surface radially outward of the casing. In the example well system 100 of FIG. 1, the system 100 includes a first, outer liner or casing 108, such as a surface casing, defined by lengths of tubing lining a first portion of the wellbore 102 extending from the surface 105 into the Earth. Outer casing 108 is shown as extending only partially down the wellbore 102 and into the subterranean zone 106; however, the outer casing 108 can extend further into the wellbore 102 or end further uphole in the wellbore 102 than what is shown schematically in FIG. 1.

A first annulus 109, radially outward of the outer casing 108 between the outer casing 108 and an inner wall of the wellbore 102, is shown as filled with cement. The example well system 100 also includes a second, inner liner or casing 110 positioned radially inward from the outer casing 108 and defined by lengths of tubing lining a second portion of the wellbore 102 that extends further downhole of the wellbore 102 than the first casing 108. The inner casing 110 is shown as extending only partially down the wellbore 102 and into the subterranean zone 106, with a remainder of the wellbore 102 shown as open-hole (for example, without a liner or casing); however, the inner casing 110 can extend further into the wellbore 102 or end further uphole in the wellbore 102 than what is shown schematically in FIG. 1.

A second annulus 112, radially outward of the inner casing 110 and between the outer casing 108 and the inner casing 110, is shown as filled with cement. The second annulus 112 can be filled partly or completely with cement. This second annulus 112 can be referred to as a casing-casing annulus, because it is an annulus between two tubular casings in a wellbore.

While FIG. 1 shows the example well system 100 as including two casings (outer casing 108 and inner casing 110), the well system 100 can include more casings, such as three, four, or more casings.

Figure 2:
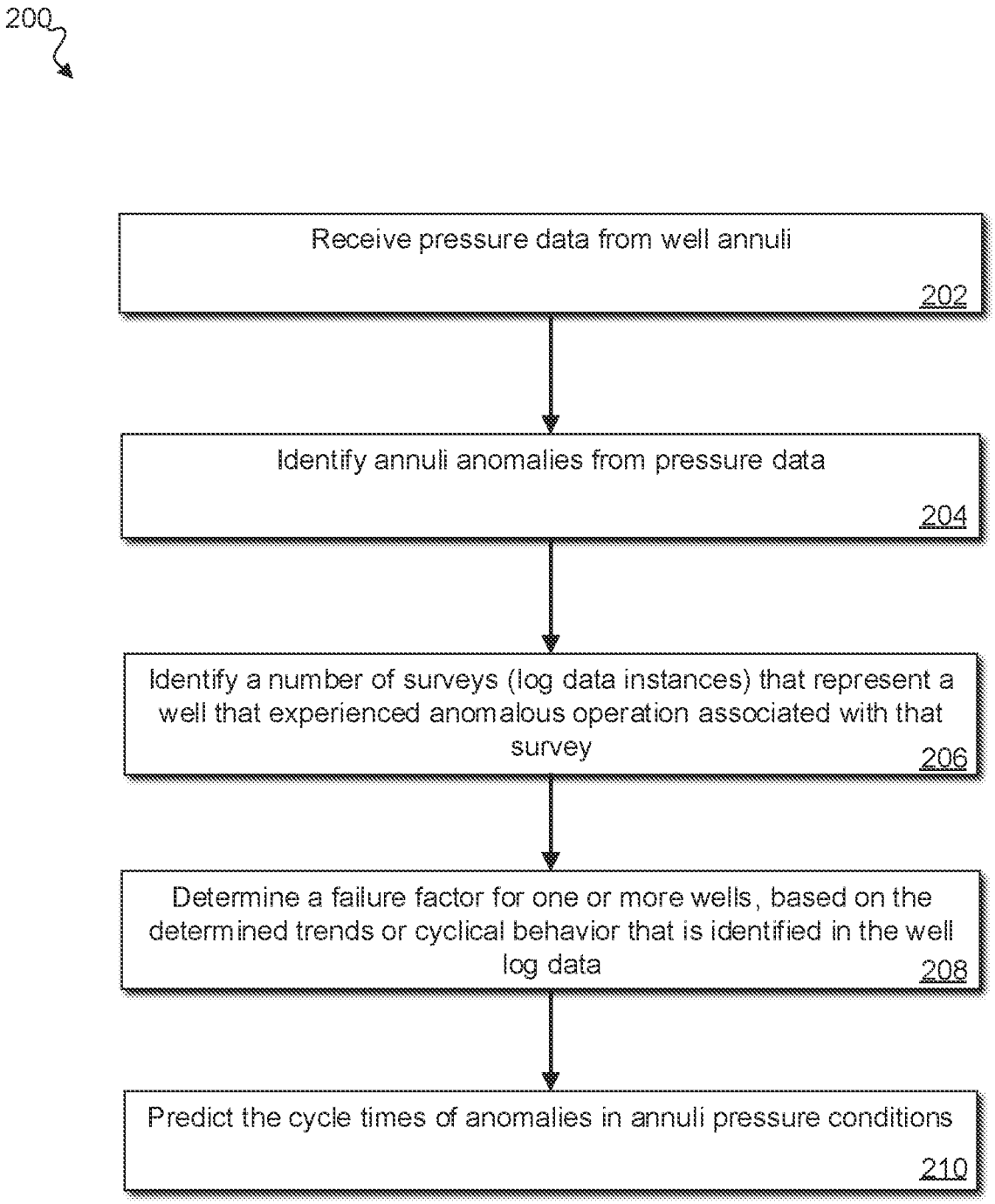
FIG. 2 illustrates a flow diagram including an example process for annuli pressure monitoring and reporting for hydrocarbon wells.

FIG. 2 illustrates a flow diagram including an example process 200 for annuli pressure monitoring and reporting for hydrocarbon wells. The process 200 can be performed by a data processing system, such as the computing system 500 described in relation to FIG. 5. In some implementations, the process 200 can be performed individually or in combination with other processes 300 and 400 described in this specification.

The data processing system is configured to receive (202) data representing latest annuli pressures from a well, such as well system 100. The data can include well log data. The data processing system is configured to identify (204) anomalies in the pressure data. The data processing system identifies anomalies in the pressure data by comparing the received data values to threshold values. For example, the data processing system is configured to identify zero TCA pressure under a flowing condition. The data processing system is configured to identify a very high TCA that is above a maximum allowable pressure. The maximum allowable pressure depends on wellhead specifications and a maximum test pressure of the TCA, whichever is greater. For example, the maximum allowable pressure can be about 1,500 psi. The data processing system is configured to detect a high CCA pressure. The CCA is usually cemented to surface and it should have zero pressure. However, a threshold limit can be set depending on the Company's guideline. For our case, the threshold limit is set to zero. The data processing system is configured to detect an equal tubing and TCA pressure under SI (shut-in) condition.

The data processing system analyzes the historical and current well log data to find instances of the anomalies with the data. The data processing system determines if remedial actions were taken that are responsive to the anomalies detected in the data, and how the remedial actions (if any) affected well operations. The data processing system is configured to analyze the log data as described in a following example. The data processing system determines a date of a survey with an identified anomaly, such as a zero TCA. The data processing system, for example, determines that a current survey shows a zero TCA anomaly. The data processing system then analyzes the historical data. The data processing system determines that there is a positive annuli pressure for a previous log at an earlier date. The data processing system determines if there is a successful TCA refilling that occurred. The data processing system determines that a previous survey showed a zero TCA anomaly. The data processing system determines that there is a positive annuli pressure in a later dated log. The data processing system determines if there is a successful TCA refilling that occurred.

The data processing system identifies (206) a number of surveys (log data instances) that represent a well that experienced anomalous operation associated with that survey. The data processing system determines a trend or cyclical behavior associated with wells represented in the log data.

The data processing system determines (208) a failure factor for one or more wells, based on the determined trends or cyclical behavior that is identified in the well log data. The data processing system calculates the failure factor. The failure factor represents pressure decline or build-up rates for the well. To determine the failure factor, the data processing system determines an average pressure drop or build-up per day between survey intervals.

The data processing system, based on the determined failure factor, predicts (210) the cycle times of anomalies in annuli pressure conditions. The prediction can be based on the trend data observed in the annuli surveys, including the dates, times, and pressures associated with each well log. The prediction is based on determined TCA refilling jobs, including a date, time, and volume associated with each refilling job. All the input data will be integrated into a central database. After each annuli survey or TCA refilling operation, the job data will be uploaded into the database which will serve as an input to the model. The model will be continuously calibrated and matured in order to predict future failures.

The data processing system trains a machine learning model using data sets that mimic actual pressure trends. For example, the data processing system receives labeled data that represents pressure build-up or decline rates for a well or for each well in a group of wells. These data are labeled with one or more anomalies that are represented in the data. The labeled data are input into a machine learning model (e.g., neural network, classifier, etc.) in which the decline rates or build up rates are labeled with anomalies as representing the features of the data. The data processing system trains the machine learning model to associate particular pressure data signatures with particular anomalies. Other portions of the data may include a well configuration for each well. These data can also be used as input data for training the machine learning model such that different models are developed for different well types. Examples of data used by data processing system to train the machine learning models are shown below.

Table 1 shows a prototype example of a well (Well A) with several annuli surveys recorded. The data include representations of successful TCA refilling jobs performed when the well has zero TCA pressure. The data represent a pressure test that is completed for the well.

TABLE 1

Example Well Data

| # | Well# | Date | Days | FWHP | TCA | CCA1 | CCA2 |
|---|---|---|---|---|---|---|---|
| 1 | A | Jan. 1, 2020 | 0 | 700 | 500 | 0 | 0 |
| 2 | A | Jan. 3, 2020 | 60 | 700 | 200 | 0 | 0 |
| 3 | A | Jan. 6, 2020 | 90 | 680 | 0 | 0 | 0 |
| TCA Refilling Job Completed | | | | | | | |
| 4 | A | Jan. 7, 2020 | 0 | 700 | 800 | 0 | 0 |
| 5 | A | Jan. 8, 2020 | 30 | 650 | 650 | 0 | 0 |
| 6 | A | Jan. 11, 2020 | 90 | 650 | 300 | 0 | 0 |
| 7 | A | Jan. 12, 2020 | 30 | 660 | 50 | | |
| 8 | A | Jan. 1, 2021 | 30 | 700 | 0 | | |
| TCA Refilling Job Completed | | | | | | | |
| 9 | A | Jan. 2, 2021 | 0 | 720 | 1000 | 0 | 0 |
| 10 | A | Jan. 3, 2021 | 30 | 720 | 880 | 0 | 0 |
| 11 | A | Jan. 4, 2021 | 30 | 720 | 675 | 0 | 0 |
| 12 | A | Jan. 5, 2021 | 30 | 700 | 488 | 0 | 0 |
| 13 | A | Jan. 6, 2021 | 30 | 620 | 290 | 0 | 0 |
| 14 | A | Jan. 7, 2021 | 30 | 690 | 130 | 0 | 0 |
| 15 | A | Jan. 8, 2021 | 30 | 690 | 0 | 0 | 0 |
| TCA Refilling Job Completed | | | | | | | |
| 16 | A | Jan. 9, 2021 | 0 | 650 | 500 | 0 | 0 |

The following calculations represent an example of determining, by the data processing system, pressure decline or build-up rates. For the first TCA pressure decline cycle, the data processing system calculates a pressure decline rate between the 1st and 2nd annuli survey of Table 1. For each equation, PDR is the pressure decline rate.

$$PDR\,(\text{psi/day}) = \frac{\Delta P_{TCA}}{\Delta t} = \frac{(500-200)}{60} = 5.0\ \text{psi/day}$$

The data processing system calculates the pressure decline rate between 2nd and 3rd annuli survey:

$$PDR\,(\text{psi/day}) = \frac{\Delta P_{TCA}}{\Delta t} = \frac{(200-0)}{90} = 2.2\ \text{psi/day}$$

The data processing system calculates that the 3rd annuli survey shows zero TCA pressure. The data processing system calculates the average PDR for Well-A during the first cycle.

$$\text{Average } PDR_{Cycle1}\,(\text{psi/day}) = \frac{(5+2.2)}{2} = 3.6\ \text{psi/day}$$

The data processing system determines that a TCA refilling job was completed and a new decline rate cycle was started. The data processing system calculates the pressure decline rate between 4th and 5th annuli survey:

$$PDR\,(\text{psi/day}) = \frac{\Delta P_{TCA}}{\Delta t} = \frac{(800-650)}{30} = 5.0\ \text{psi/day}$$

The data processing system calculates the pressure decline rate between 5th and 6th annuli survey:

$$PDR\,(\text{psi/day}) = \frac{\Delta P_{TCA}}{\Delta t} = \frac{(650-300)}{90} = 3.9\ \text{psi/day}$$

The data processing system calculates the pressure decline rate between 6th and 7th annuli survey:

$$PDR\,(\text{psi/day}) = \frac{\Delta P_{TCA}}{\Delta t} = \frac{(300-50)}{30} = 8.3\ \text{psi/day}$$

The data processing system calculates the pressure decline rate between 7th and 8th annuli survey:

$$PDR\,(\text{psi/day}) = \frac{\Delta P_{TCA}}{\Delta t} = \frac{(50-0)}{30} = 1.7\ \text{psi/day}$$

The data processing system determines that the 8th annuli survey shows zero TCA pressure. The data processing system calculates the average PDR for Well-A during the second cycle:

$$\text{Average } PDR_{Cycle2}\,(\text{psi/day}) = \frac{(5+3.9+8.3+1.7)}{2} = 4.7\ \text{psi/day}$$

The data processing system determines that a TCA refilling job is completed and a new decline rate cycle is started. The data processing system calculates the pressure decline rate between 9th and 10th annuli survey:

$$PDR\,(\text{psi/day}) = \frac{\Delta P_{TCA}}{\Delta t} = \frac{(1000-880)}{30} = 4.0\ \text{psi/day}$$

The data processing system calculates the pressure decline rate between 10th and 11th annuli survey:

$$PDR\,(\text{psi/day}) = \frac{\Delta P_{TCA}}{\Delta t} = \frac{(880-675)}{30} = 6.8\ \text{psi/day}$$

The data processing system calculates the pressure decline rate between 11th and 12th annuli survey:

$$PDR\,(\text{psi/day}) = \frac{\Delta P_{TCA}}{\Delta t} = \frac{(675-488)}{30} = 6.2\ \text{psi/day}$$

The data processing system calculates the pressure decline rate between 12th and 13th annuli survey:

$$PDR\,(\text{psi/day}) = \frac{\Delta P_{TCA}}{\Delta t} = \frac{(488-290)}{30} = 6.6\ \text{psi/day}$$

The data processing system calculates the pressure decline rate between 13th and 14th annuli survey:

$$PDR\,(\text{psi/day}) = \frac{\Delta P_{TCA}}{\Delta t} = \frac{(290-130)}{30} = 5.3\ \text{psi/day}$$

The data processing system calculates the pressure decline rate between 14th and 15th annuli survey:

$$PDR\,(\text{psi/day}) = \frac{\Delta P_{TCA}}{\Delta t} = \frac{(130-0)}{30} = 4.3\ \text{psi/day}$$

The data processing system determines that the 16th annuli survey shows zero TCA pressure. The data processing system calculates an average PDR for the well (Well-A) during the second cycle:

$$\text{Average } PDR_{Cycle3}\,(\text{psi/day}) = \frac{(4.0+6.8+6.2+6.6+5.3+4.3)}{6} = 5.6\ \text{psi/day}$$

The data processing system determines that a TCA refilling job is completed and a new decline rate cycle is started. The data processing system calculates an expected number of days (108) for TCA pressure to reach to zero.

$$\text{Days}_{P_{TCA}\to 0} = \frac{P_{TCA}}{\text{Average } PDR} = \frac{500}{\frac{(3.6+4.7+5.6)}{3}} = 108\ \text{Days}$$

The data processing system can use the process shown for the PDR with the rapid increase in annulus pressure by calculating for the average pressure build-up rate PBR.

Figure 3:
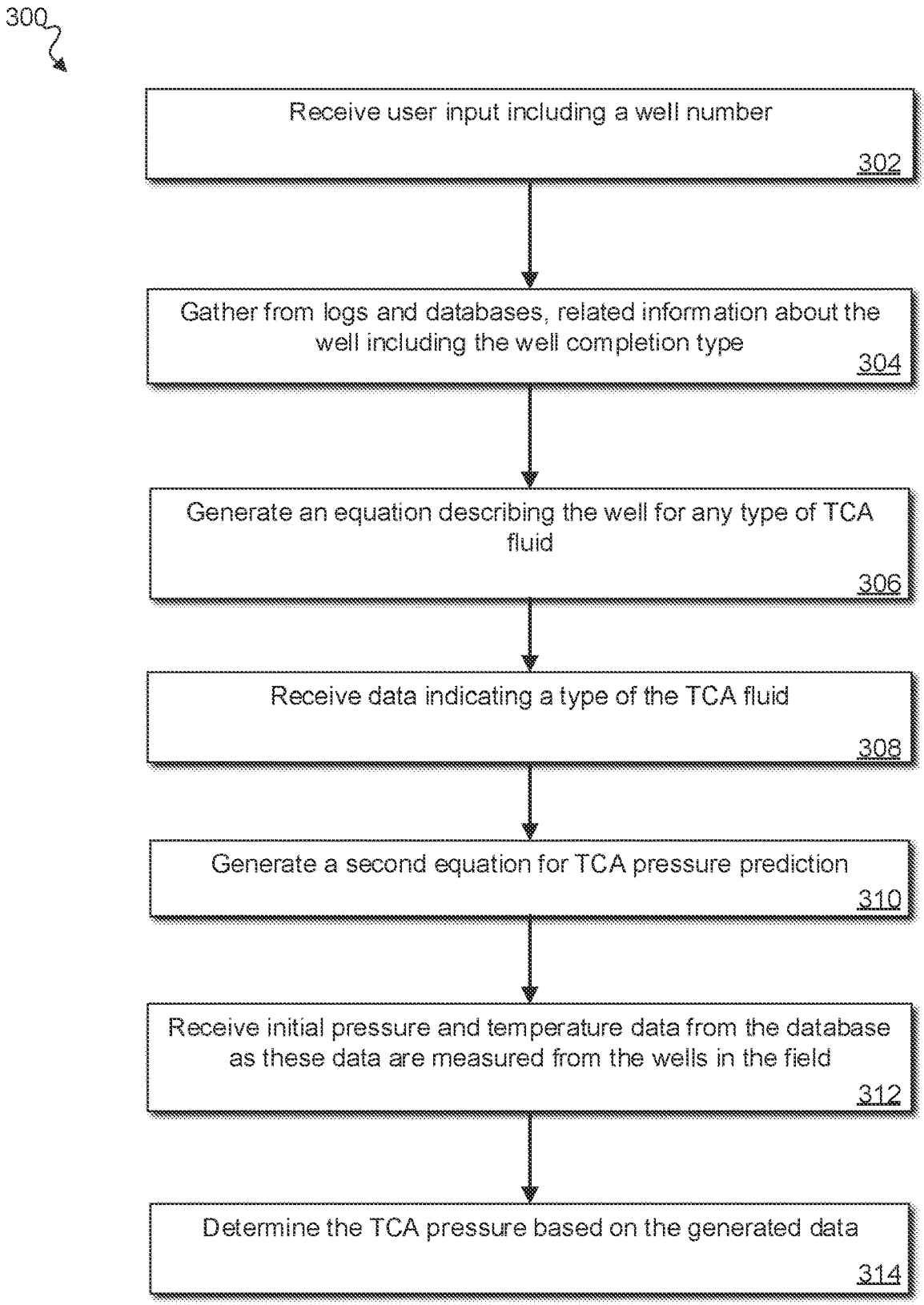
FIG. 3 illustrates a flow diagram including an example process for annuli pressure cycle prediction for hydrocarbon wells.

FIG. 3 illustrates a flow diagram including an example process 300 for annuli pressure cycle prediction for hydrocarbon wells. The process 300 can be performed by a data processing system, such as the computing system 500 described in relation to FIG. 5. In some implementations, the process 300 can be performed individually or in combination with other processes 200 and 400 described in this specification.

The data processing system is configured to receive (302) user input including a well number. The data processing system is configured to gather (304), from logs and databases, related information about the well including the well completion type. Examples include casing and tubing sizes, tubular grades, weights per foot, and other relevant data which will aid in the calculation of the required mechanical properties. The ID (inner diameter) is an input data for the production casing, as well as the thickness of production casing (e.g. the thickness of a 7" casing is 1.0"). The data processing system can build a profile of the well from these well data. Generally, the type of completion defines an elastic modulus of a vessel (e.g., annulus) of the well, in addition to a volumetric coefficient of thermal expansion of the vessel.

The data processing system generates (306) an equation describing the well for any type of TCA fluid. The equation is generated based on an equation with corresponding contribution to the relative change in volume Av/y of fluid or of the containing space, where V represents volume. The equations evaluated to build the general equation are as follows:

$$\propto_f \Delta T$$

$$\propto_V \Delta T$$

$$\beta \Delta P$$

$$(\Delta P * D)/(t * E)$$

where: $\propto_f$ the volumetric coefficient of thermal expansion of the fluid; $\propto_V$ is the volumetric coefficient of thermal expansion of the vessel; ΔT is the change in temperature; β is the compressibility factor of the fluid; and −ΔP is the change in pressure of the fluid (the desired output). D, t, and E are respectively a diameter, a thickness and an elastic modulus of the vessel being analyzed.

The data processing system equates the change in volume of the fluid to the change in volume of the vessel:

$$\propto_f \Delta T - \beta \Delta P = \propto_V \Delta T + \frac{\Delta P * D}{t * E} \tag{1}$$

$$\Delta P = \frac{(\propto_f - \propto_V)\Delta T}{\left(\beta + \frac{D}{t * E}\right)} \tag{2}$$

The data processing system processes the well data gathered from the database to generate an equation to be used for any type of TCA fluid. The data processing system generates the equation based on the following completion parameters as inputs: $\propto_V$, D, t and E.

The data processing system is configured to receive (308) data indicating a type of the TCA fluid. Types of fluids include diesel, inhibited water, and so forth. The data processing system prediction is updated based on the fluid properties, such as a volumetric coefficient and a compressibility. Generally, sample data provided below refers to an example using diesel fluid. If these data are available for the well, the data processing system does not need to receive the fluid type as an input.

The data processing system generates (310) a second equation for TCA pressure prediction. The data processing system generates the second equation based on the values for volumetric coefficient of thermal expansion of the fluid ($\propto_f$) as well as the compressibility factor of the fluid (β).

The data processing system receives (312) initial pressure and temperature data from the database as these data are measured from the wells in the field. The data processing system assumes a final temperature based on offset wells having a same well type and in the same reservoir.

The data processing system determines (314) the TCA pressure based on the generated data. The data processing system presents the data, typically in the form of PSI.

Figure 4:
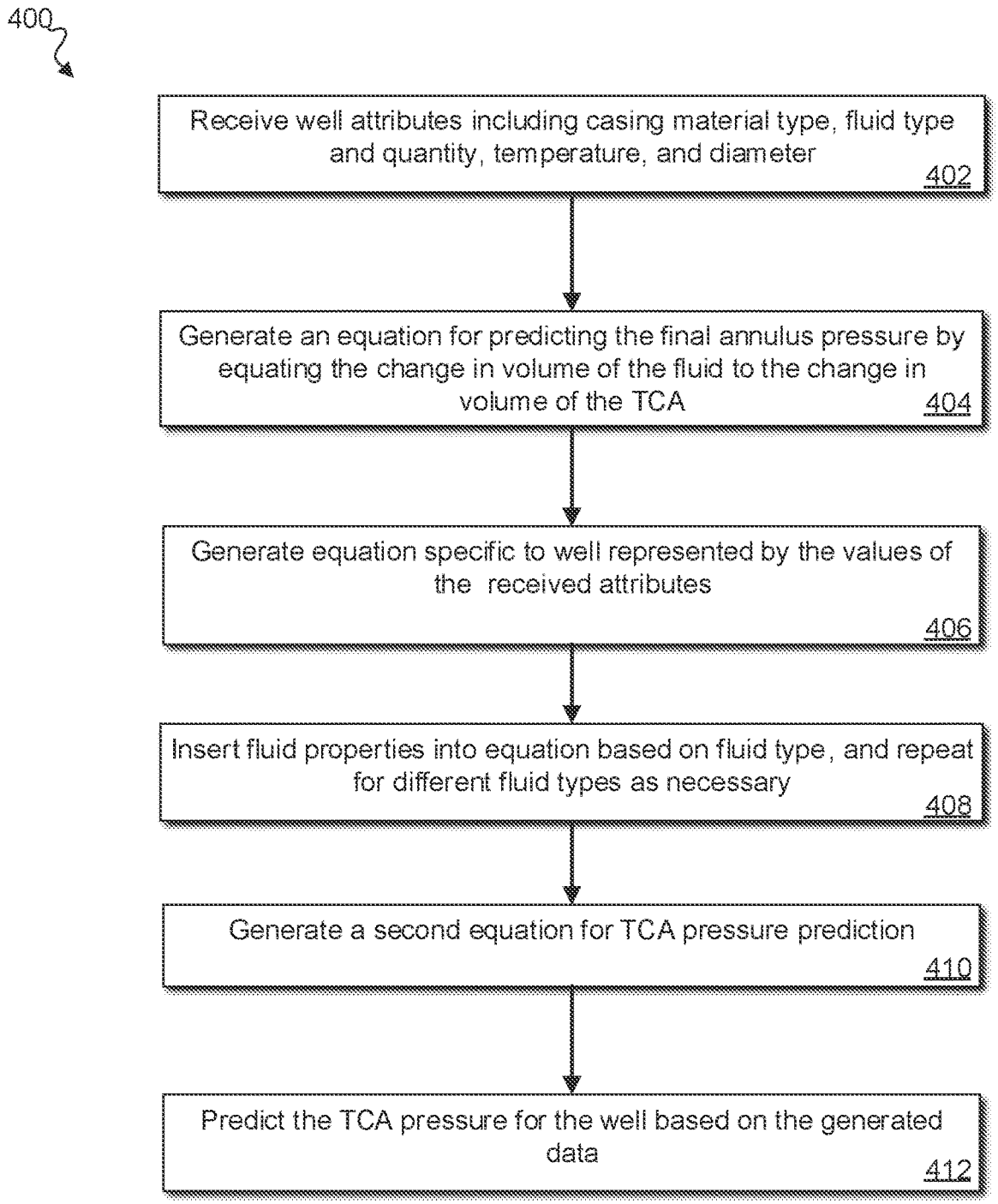
FIG. 4 illustrates a flow diagram including an example process for annuli pressure cycle prediction for hydrocarbon wells.

FIG. 4 illustrates a flow diagram including an example process 400 for annuli pressure cycle prediction for hydrocarbon wells. The process 400 can be performed by a data processing system, such as the computing system 500 described in relation to FIG. 5. In some implementations, the process 400 can be performed individually or in combination with other processes 200 and 300 described in this specification. The process 400 is a special example of the generalized process 300 of FIG. 3.

The data processing system receives (402) well attributes including a well with 4½" tubing, 26.00 #7" carbon steel casing, and a TCA filled with diesel. Equation 3 is generated (404) by the data processing system for predicting the final annulus pressure by equating the change in volume of the fluid to the change in volume of the TCA.

$$\Delta P = \frac{(\propto_f - \propto_V)\Delta T}{\left(\beta + \frac{D}{t * E}\right)} \tag{3}$$

The data processing system receives well type data and generates (406) equation 6, which is specific to this particular well. The derivation of equation 6 based on given well data is shown below. For example, the generated equation is based on a well with carbon steel completion ($\propto_V$=1.17×$10^{-5\circ}$ C.$^{-1}$) that has a diameter (D) and wall thickness (t) of 6.5" and 0.362", respectively. The following equation 6 is to be used for all future calculations to predict the final TCA pressure in a well with 26.00 #7" carbon steel casing.

$$P_f = P_i + \frac{(\propto_f - 1.17 \times 10^{-5\circ}\ \text{C.}^{-1})\Delta T}{(6.1895 \times 10^{-7}\ \text{psi}^{-1} + \beta)} \tag{4}$$

$$\Delta P = \frac{(\propto_f - 1.17 \times 10^{-5\circ}\ \text{C.}^{-1})\Delta T}{\left(\beta + \frac{6.5}{0.362 * 2.901 \times 10^{7}\ \text{psi}}\right)} \tag{5}$$

$$\Delta P = \frac{(\propto_f - 1.17 \times 10^{-5\circ}\ \text{C.}^{-1})\Delta T}{(6.1895 \times 10^{-7}\text{psi}^{-1} + \beta)} \tag{6}$$

Furthermore, in this example, the TCA is filled completely with diesel. The data processing system receives (408) fluid type data indicating that the well includes diesel. This step can be repeated for changes in fluid type. The data processing system generates (410) equation 9 based on the well properties and the properties of diesel fluid.

$$\text{Diesel}\ \propto_f = 8.3 \times 10^{-40\circ}\ \text{F.}^{-1}$$

$$\text{Diesel}\ \beta = 6.49 \times 10^{-6}\ \text{psi}^{-1}$$

$$P_f = P_i + \frac{(8.3 \times 10^{-4\circ}\ \text{C.}^{-1} - 1.17 \times 10^{-5\circ}\ \text{C.}^{-1})\Delta T}{(6.1895 \times 10^{-7}\ \text{psi}^{-1} + 6.49 \times 10^{-6}\ \text{psi}^{-1})}$$

or (7)

-continued $$P_f = P_i + \frac{(8.183 \times 10^{-4\circ}\ \text{C.}^{-1})\Delta T}{(7.109 \times 10^{-6}\ \text{psi}^{-1})} \tag{8}$$

$$P_f = P_i + \left(115\ \frac{\text{psi}}{\circ\ \text{C.}} \times \Delta T\right) \tag{9}$$

Equation 9 is used by the data processing system to predict (412) a final pressure from an initial pressure for this well, such as when the TCA is filled completely with diesel and the well is completed with 26.00 #7" carbon steel casing.

The following examples show data for a newly drilled or TCA refilled wells.

| Well# | SIWHP, psi | Initial T, ° C. | Initial TCAP, psi | FWHP, psi | Final T, ° C. | Predicted TCAP, psi |
|---|---|---|---|---|---|---|
| Well-A | 600 | 60 | 0 | 300 | 85 | 2,875 |
| Well-B | 700 | 63 | 300 | 400 | 87 | 3,060 |
| Well-C | 800 | 66 | 500 | 500 | 90 | 3,260 |

The data processing system gathers data for the pressure and temperature from the field, which are the following values: $T_i$=60° C.; $T_f$=85° C.; $P_i$=0 psi. The data processing system generates a value of the final pressure based on equation 9. The final pressure inside the TCA due to the thermal expansion of fluid is: Pf=2875 PSI. Therefore, the data processing system executes an analytical thermal expansion model for predicting TCA pressure due to thermal expansion of wellbore fluids as the well is put on initial production. The data processing system can automatically profile the well and predict annulus pressure using widely available data that are logged in a database.

FIG. 5 is a block diagram of an example computing system 500 used to provide computational functionalities associated with described algorithms, methods, functions, processes, flows, and procedures described in the present disclosure, according to some implementations of the present disclosure. In some implementations, the computing system 500 is a data processing system configured to perform processes 200, 300, and 400. The illustrated computer 502 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 502 can include input devices such as keypads, keyboards, and touch screens that can accept user information. Also, the computer 502 can include output devices that can convey information associated with the operation of the computer 502. The information can include digital data, visual data, audio information, or a combination of information. The information can be presented in a graphical user interface (UI) (or GUI).

The computer 502 can serve in a role as a client, a network component, a server, a database, a persistency, or components of a computer system for performing the subject matter described in the present disclosure. The illustrated computer 502 is communicably coupled with a network 524. In some implementations, one or more components of the computer 502 can be configured to operate within different environments, including cloud-computing-based environments, local environments, global environments, and combinations of environments.

At a high level, the computer 502 is an electronic computing device operable to receive, transmit, process, store, and manage data and information associated with the described subject matter. According to some implementations, the computer 502 can also include, or be communicably coupled with, an application server, an email server, a web server, a caching server, a streaming data server, or a combination of servers.

The computer 502 can receive requests over network 524 from a client application (for example, executing on another computer 502). The computer 502 can respond to the received requests by processing the received requests using software applications. Requests can also be sent to the computer 502 from internal users (for example, from a command console), external (or third) parties, automated applications, entities, individuals, systems, and computers.

Each of the components of the computer 502 can communicate using a system bus 504. In some implementations, any or all of the components of the computer 502, including hardware or software components, can interface with each other or the interface 506 (or a combination of both), over the system bus 504. Interfaces can use an application programming interface (API) 514, a service layer 516, or a combination of the API 514 and service layer 516. The API 514 can include specifications for routines, data structures, and object classes. The API 514 can be either computer-language independent or dependent. The API 514 can refer to a complete interface, a single function, or a set of APIs.

The service layer 516 can provide software services to the computer 502 and other components (whether illustrated or not) that are communicably coupled to the computer 502. The functionality of the computer 502 can be accessible for all service consumers using this service layer. Software services, such as those provided by the service layer 516, can provide reusable, defined functionalities through a defined interface. For example, the interface can be software written in JAVA, C++, or a language providing data in extensible markup language (XML) format. While illustrated as an integrated component of the computer 502, in alternative implementations, the API 514 or the service layer 516 can be stand-alone components in relation to other components of the computer 502 and other components communicably coupled to the computer 502. Moreover, any or all parts of the API 514 or the service layer 516 can be implemented as child or sub-modules of another software module, enterprise application, or hardware module without departing from the scope of the present disclosure.

The computer 502 includes an interface 506. Although illustrated as a single interface 506 in FIG. 5, two or more interfaces 506 can be used according to particular needs, desires, or particular implementations of the computer 502 and the described functionality. The interface 506 can be used by the computer 502 for communicating with other systems that are connected to the network 524 (whether illustrated or not) in a distributed environment. Generally, the interface 506 can include, or be implemented using, logic encoded in software or hardware (or a combination of software and hardware) operable to communicate with the network 524. More specifically, the interface 506 can include software supporting one or more communication protocols associated with communications. As such, the network 524 or the hardware of the interface can be operable to communicate physical signals within and outside of the illustrated computer 502.

The computer 502 includes a processor 508. Although illustrated as a single processor 508 in FIG. 5, two or more processors 508 can be used according to particular needs, desires, or particular implementations of the computer 502 and the described functionality. Generally, the processor 508 can execute instructions and can manipulate data to perform the operations of the computer 502, including operations using algorithms, methods, functions, processes, flows, and procedures as described in the present disclosure.

The computer 502 also includes a database 520 that can hold data (for example, seismic data 522) for the computer 502 and other components connected to the network 524 (whether illustrated or not). For example, database 520 can be an in-memory, conventional, or a database storing data consistent with the present disclosure. In some implementations, database 520 can be a combination of two or more different database types (for example, hybrid in-memory and conventional databases) according to particular needs, desires, or particular implementations of the computer 502 and the described functionality. Although illustrated as a single database 520 in FIG. 5, two or more databases (of the same, different, or combination of types) can be used according to particular needs, desires, or particular implementations of the computer 502 and the described functionality. While database 520 is illustrated as an internal component of the computer 502, in alternative implementations, database 520 can be external to the computer 502.

The computer 502 also includes a memory 510 that can hold data for the computer 502 or a combination of components connected to the network 524 (whether illustrated or not). Memory 510 can store any data consistent with the present disclosure. In some implementations, memory 510 can be a combination of two or more different types of memory (for example, a combination of semiconductor and magnetic storage) according to particular needs, desires, or particular implementations of the computer 502 and the described functionality. Although illustrated as a single memory 510 in FIG. 5, two or more memories 510 (of the same, different, or combination of types) can be used according to particular needs, desires, or particular implementations of the computer 502 and the described functionality. While memory 510 is illustrated as an internal component of the computer 502, in alternative implementations, memory 510 can be external to the computer 502.

The application 512 can be an algorithmic software engine providing functionality according to particular needs, desires, or particular implementations of the computer 502 and the described functionality. For example, application 512 can serve as one or more components, modules, or applications. Further, although illustrated as a single application 512, the application 512 can be implemented as multiple applications 512 on the computer 502. In addition, although illustrated as internal to the computer 502, in alternative implementations, the application 512 can be external to the computer 502.

The computer 502 can also include a power supply 518. The power supply 518 can include a rechargeable or non-rechargeable battery that can be configured to be either user- or non-user-replaceable. In some implementations, the power supply 518 can include power-conversion and management circuits, including recharging, standby, and power management functionalities. In some implementations, the power-supply 518 can include a power plug to allow the computer 502 to be plugged into a wall socket or a power source to, for example, power the computer 502 or recharge a rechargeable battery.

There can be any number of computers 502 associated with, or external to, a computer system containing computer 502, with each computer 502 communicating over network 524. Further, the terms "client," "user," and other appropriate terminology can be used interchangeably, as appropriate, without departing from the scope of the present disclosure. Moreover, the present disclosure contemplates that many users can use one computer 502 and one user can use multiple computers 502.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

What is claimed is:

1. A method for monitoring pressure in hydrocarbon wells for controlling operation of the hydrocarbon well, the method comprising:

receiving pressure data for a well, the pressure data comprising values of a pressure in a well annulus over a period of time for a set of wells;

identifying one or more anomalies in the pressure data by comparing the values of the pressure to threshold values, the one or more anomalies in the pressure data representing an anomalous pressure condition for the well;

determining, based on the one or more anomalies, a failure factor for each of one or more wells associated with the one or more anomalies;

wherein the one or more anomalies comprise at least one of a zero pressure in a tubing casing annulus (TCA) of a well under a flowing condition, a pressure over a maximum threshold pressure in the TCA, a casing-casing annulus (CCA) pressure that exceeds a threshold, and an equal tubing and TCA pressure when the well is shut-in;

predicting, based on the failure factor, a point in time in a pressure cycle of each of the one or more wells for occurrence of the one or more anomalies in the pressure data for each of the one or more wells.

2. The method of claim 1, wherein the failure factor comprises a pressure build up rate or a pressure decline rate for each well of the one or more wells.

3. The method of claim 1, further comprising:

receiving labeled data representing pressure build up rates and pressure decline rates for one or more wells of the set of wells, wherein the labeled data are labeled with known anomalies that are included in the labeled data for the one or more wells of the set of wells; and training a machine learning model using the labeled data, the machine learning model being trained to predict the point in time of the one or more anomalies in the pressure data for the one or more wells.

4. The method of claim 1, further comprising:

selecting, based on the predicting, at least one remedial action for at least one well of the one or more wells; and controlling performance of the at least one remedial action for the at least one well of the one or more wells.

5. The method of claim 4, wherein the at least one remedial action comprises at least one of a as TCA refill, a TCA lubrication, and a pressure bleed-off for the well of the set of wells.

6. The method of claim 1, further comprising:

controlling a pressure in the well, based on the predicting, wherein controlling comprises causing one or more of a pressure bleed off event and generation of a notification instructing an operator to inspect the well for leakage or blockage, the notification being transmitted to the operator.

7. The method of claim 1, further comprising:

accessing a trained machine learning model associating one or more anomalies in the pressure data of the well with data representing a given remedial action responsive to the one or more anomalies and how a remedial action affected well operations of the well.

8. A system configured for monitoring pressure in hydrocarbon wells for controlling operation of the hydrocarbon well, the system comprising:

at least one processor; and a memory storing instructions that, when executed by the at least one processor, cause the at least one processor to perform operations comprising:

receiving pressure data for a well, the pressure data comprising values of a pressure in a well annulus over a period of time for a set of wells;

identifying one or more anomalies in the pressure data by comparing the values of the pressure to threshold values, the one or more anomalies in the pressure data representing an anomalous pressure condition for the well;

determining, based on the one or more anomalies, a failure factor for each of one or more wells associated with the one or more anomalies;

wherein the one or more anomalies comprise at least one of a zero pressure in a tubing casing annulus (TCA) of a well under a flowing condition, a pressure over a maximum threshold pressure in the TCA, a casing-casing annulus (CCA) pressure that exceeds a threshold, and an equal tubing and TCA pressure when the well is shut-in;

predicting, based on the failure factor, a point in time in a pressure cycle of each of the one or more wells for occurrence of the one or more anomalies in the pressure data for each of the one or more wells;

selecting, based on the predicting, at least one remedial action for at least one well of the one or more wells; and controlling performance of the at least one remedial action for the at least one well of the one or more wells.

9. The system of claim 8, wherein the failure factor comprises a pressure build up rate or a pressure decline rate for each well of the one or more wells.

10. The system of claim 8, the operations further comprising:

receiving labeled data representing pressure build up rates and pressure decline rates for one or more wells of the set of wells, wherein the labeled data are labeled with known anomalies that are included in the labeled data for the one or more wells of the set of wells; and training a machine learning model using the labeled data, the machine learning model being trained to predict the point in time of the one or more anomalies in the pressure data for the one or more wells.

11. The system of claim 8, the operations further comprising:

selecting, based on the predicting, at least one remedial action for at least one well of the one or more wells; and controlling performance of the at least one remedial action for the at least one well of the one or more wells.

12. The system of claim 11, wherein the at least one remedial action comprises at least one of a as TCA refill, a TCA lubrication, and a pressure bleed-off for the well of the set of wells.

13. The system of claim 8, the operations further comprising:

controlling a pressure in the well, based on the predicting, wherein controlling comprises causing one or more of a pressure bleed off event and generation of a notification instructing an operator to inspect the well for leakage or blockage, the notification being transmitted to the operator.

14. One or more non-transitory computer readable media storing instructions for monitoring pressure in hydrocarbon wells for controlling operation of the hydrocarbon well, the instructions when executed by at least one processor, configured to cause the at least one processor to perform operations comprising:

receiving pressure data for a well, the pressure data comprising values of a pressure in a well annulus over a period of time for a set of wells;

one or more anomalies in the pressure data by comparing the values of the pressure to threshold values, the one or more anomalies in the pressure data representing an anomalous pressure condition for the well;

determining, based on the one or more anomalies, a failure factor for each of one or more wells associated with the one or more anomalies;

predicting, based on the failure factor, a point in time in a pressure cycle of each of the one or more wells for occurrence of the one or more anomalies in the pressure data for each of the one or more wells;

selecting, based on the predicting, at least one remedial action for at least one well of the one or more wells; and causing the at least one remedial action for the at least one well of the one or more wells.

15. The one or more non-transitory computer readable media of claim 14, wherein the failure factor comprises a pressure build up rate or a pressure decline rate for each well of the one or more wells.

16. The one or more non-transitory computer readable media of claim 14, the operations further comprising:

receiving labeled data representing pressure build up rates and pressure decline rates for one or more wells of the set of wells, wherein the labeled data are labeled with known anomalies that are included in the labeled data for the one or more wells of the set of wells; and training a machine learning model using the labeled data, the machine learning model being trained to predict the cycle point in time of the one or more anomalies in the pressure data for the one or more wells.

17. The one or more non-transitory computer readable media of claim 14, the operations further comprising:

selecting, based on the predicting, at least one remedial action for at least one well of the one or more wells; and controlling performance of the at least one remedial action for the at least one well of the one or more wells.

18. The one or more non-transitory computer readable media of claim 17, wherein the at least one remedial action comprises at least one of a as TCA refill, a TCA lubrication, and a pressure bleed-off for the well of the set of wells.

* * * * *